United States Patent [19]

Isaksson et al.

[11] 4,339,271

[45] Jul. 13, 1982

[54] METHOD OF MANUFACTURING A SINTERED POWDER BODY

[75] Inventors: Sven-Erik Isaksson; Hans Larker, both of Robertsfors, Sweden

[73] Assignee: Asea AB, Västerås, Sweden

[21] Appl. No.: 919,916

[22] Filed: Jun. 28, 1978

Related U.S. Application Data

[63] Continuation of Ser. No. 378,998, Jul. 13, 1973, abandoned, which is a continuation-in-part of Ser. No. 373,132, Jun. 25, 1973, which is a continuation of Ser. No. 230,877, Mar. 1, 1972.

[51] Int. Cl.[3] ..... B22F 3/00

[52] U.S. Cl. ..... 75/223; 75/226

[58] Field of Search ..... 75/226, 223

[56] References Cited

U.S. PATENT DOCUMENTS

| | | | |
|---|---|---|---|
| 3,455,682 | 7/1969 | Barbaras | 75/226 X |
| 3,469,976 | 9/1969 | Iler | 75/226 X |
| 3,562,371 | 2/1971 | Bush | 75/226 X |
| 4,081,272 | 3/1978 | Adlerborn | 75/226 X |
| 4,104,782 | 8/1978 | Veeck et al. | 75/226 X |

*Primary Examiner*—Brooks H. Hun

*Attorney, Agent, or Firm*—Watson, Cole, Grindle & Watson

[57] ABSTRACT

A shaped body is formed by cold-pressing a powdered material into a desired shape and then providing thereon a surface layer of a material having a lower melting point than the powder of the shaped body. The shaped body is then placed in a furnace connectable to vacuum equipment, wherein the pressure is first lowered to a value lower than atmospheric pressure and then the temperature is increased so that the material of the surface layer melts. Thereafter the body is isostatically hot-pressed under the direct influence of an inert, gaseous pressure medium, the powder particles being thus bound together to high density by pressure sintering.

11 Claims, 1 Drawing Figure

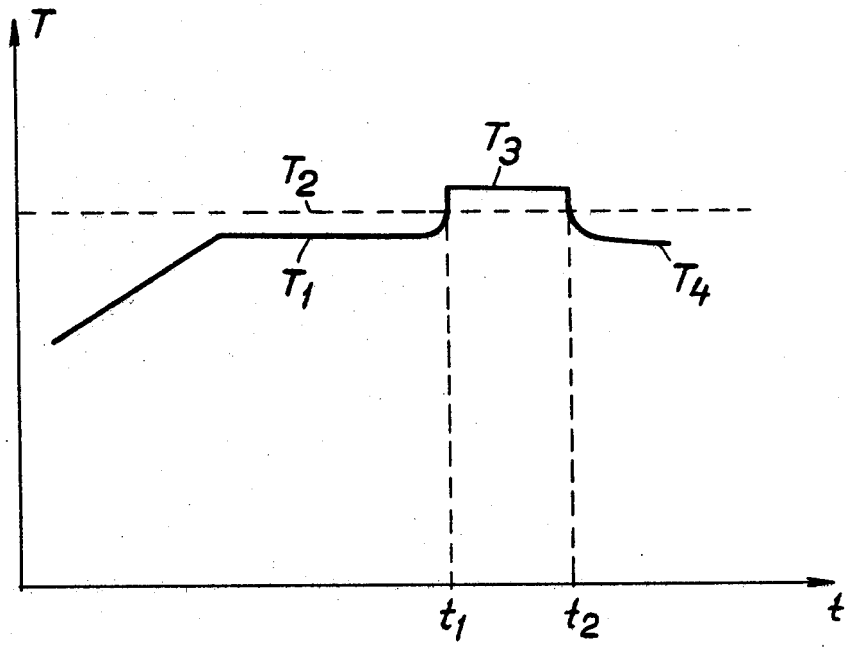
T
T2
T3
T1
T4
t1
t2
t

METHOD OF MANUFACTURING A SINTERED POWDER BODY

This application is a continuation application of application Ser. No. 378,998, filed on July 13, 1973, now abandoned, which was a continuation-in-part of our application Ser. No. 373,132, filed June 25, 1973, which is a continuation of our application Ser. No. 230,877, filed Mar. 1, 1972.

BACKGROUND OF THE INVENTION

1. Field of the Invention

The present invention relates to a method of manufacturing a sintered body from a powdered material.

2. The Prior Art

In the manufacture of tools by the sintering of metal powder bodies, high density and freedom from pores give a high quality product. In the case of cutting tools, the high density gives increased wear resistance and less risks of broken edges. In the case of rollers and the like, the freedom from pores gives increased strength and surface smoothness and this also results in a smoother surface for the product being rolled. Even in the production of electrical resistance bodies of $MoSi_2$, for instance, there are considerable advantages in having a very high density and freedom from pores. The strength increases and the risk of local over-heating with consequential burning decreases. The advantages of high density and freedom from pores are equally great for cermets of various types.

High density and freedom from pores in sintered products have previously been obtained by enclosing a pressed powder body in a gas-tight, heat-resistance casing of some suitable metal, then evacuating the casing, sealing it and placing it in a furnace wherein the material was sintered under high pressure. Temperatures and pressures of up to 1500° C. and 2000 bars have been used. It is extremely expensive to apply a casing around a pressed body, particularly if it has a complicated shape, to evacuate and seal the casing and finally to remove the casing after the sintering. Especially in the production of small cutting elements the encapsuling is disproportionately expensive. With particularly complicated components, moreover, quite apart from the economic aspects, this method of manufacture simply cannot be used since the casing cannot be removed without damaging the component.

The object of surrounding a powder body to be hot-pressed in a gaseous atmosphere with a gas-tight casing was that the casing should prevent the gaseous pressure medium from coming into contact with the powder body and penetrating into its cavities. Such penetration would result in there being no compaction obtained and hot-pressing under direct influence of a gaseous pressure medium would therefore be pointless. However, it has in recent years proved possible by means of a special method (see German Offenlegungsschrift 2 006 066) to hot-press powder bodies under direct influence of a gaseous pressure medium without enclosing the bodies in a casing. One stipulation for the success of this latter known method, however, is that the bodies consist of a material which during sintering forms a molten phase which closes the pores so that these do not communicate.

The object of the present invention is to provide a process for hot isostatic compacting of powder bodies, in which the bodies do not need to be enclosed in a casing during the compacting process and in which the choice of powder material is relatively wide. This is made possible by the method according to the invention, in which the body of powder material is cold-pressed and then provided with a surface layer of a material having a lower melting point than that of the material of the body or of a material which forms with the material of the body a eutectic which has a lower melting point than that of the material of the body. The body is then placed in a furnace where it is subjected to vacuum and heat, and is thereafter subjected to isostatic hot pressing under the direct influence of an inert gaseous medium. The material forming the outer layer should be at least highly viscous at the sintering temperature of the powder material, and the temperature at which the body is hot-pressed should be sufficient to produce sintering. When using this method the powder material need not include additives with the sole purpose of enabling compacting to take place without the use of a casing, and only such material which will give the final product high quality physical properties need be used. In comparison with a method in which the powder bodies are enclosed in a gas-tight casing, the invention is a considerable simplification. Furthermore, gases in the pores of the powder body can be evacuated more quickly and the evacuation will be more complete since it takes place over the whole surface of the body through the relatively porous surface layer and not only through a thin tube, as is the case when the body in enclosed in a gas-tight casing.

BRIEF DESCRIPTION OF THE DRAWINGS

The invention will be further described with reference to the accompanying drawing which shows a schematical temperature-time diagram for a treatment cycle in accordance with the invention.

DESCRIPTION OF THE PREFERRED EMBODIMENTS

The treatment cycle shown in the drawing can advantageously be performed in a furnace of the type described in the above-mentioned German Offenlegungsschrift. The manufacture of a sintered body in accordance with the method illustrated in the drawing is carried out as follows:

The body is first shaped by cold-pressing the powdered material, for example Mo or cemented carbide consisting of mostly WC or TiC. The cold-pressed powder body is then provided with a relatively porous surface layer of material having a lower melting point than the powder body as a whole, for example by means of flame or plasma spraying. The surface layer may even be applied by immersion. The body is then placed in the furnace mentioned above and the temperature is increased under vacuum to $T_1$, which is slightly below $T_2$, the melting point of the surface layer. The temperature is kept at this value for some time. Since the surface layer applied by flame spraying is relatively porous, the pores of the powder body will be evacuated during this period. At a moment $t_1$ the furnace temperature is increased to the value $T_3$, whereupon the surface layer melts. After this, at the moment $t_2$, the temperature is again decreased to a value $T_4$ below the melting point $T_2$ so that the surface layer solidifies and forms a gas-tight layer around the powder body. Until the moment $t_2$, a vacuum prevails in the furnace. After this moment inert gas, for example argon, is supplied under high pressure so that the powder body is sintered and compacted to extremely high density under the simultaneous action of high pressure and high temperature.

The invention is not limited to the embodiment described. Many modifications are feasible within the scope of the following claims. For instance, instead of using for the surface layer a material having its melting point at the temperature $T_2$, it is possible to use a material which together with the powder body forms a eutectic with this lower melting point. An example of such a combination of materials is molybdenum in the powder body and nickel in the surface layer. In either case, the powder body is provided, before it is isostatically hot-pressed, with a layer of a material having a lower melting point than that of the body. Furthermore, it is not absolutely necessary for the temperature to be decreased below the melting point $T_2$ so that the surface layer solidifies before the hot pressing is performed. In certain cases the hot pressing can be carried out even when the surface layer is in a fluid, high-viscous state.

It will also be understood that the vacuum-sintering and the pressure-sintering need not necessarily be performed in one and the same equipment.

EXAMPLE 1

Bodies of molybdenum powder of grain size 3 to 5 microns were cold-pressed at 3 kilobars to a density of 7.3 grams/cm$^3$. By plasma spraying these bodies were provided with a surface layer of nickel powder, the thickness of the layer for different bodies being 0.25 mm, 0.5 mm, 0.75 mm and 1.0 mm. Thereafter, the bodies were vacuum-sintered in a furnace at a pressure of 0.05 torr and a temperature of 1325° C. for 30 minutes. Thereafter, the pressure was increased to 500 bars and the temperature to 1400° C., which values were maintained so for one hour. For all bodies a density greater than 99.5% of the theoretical maximum was obtained.

EXAMPLE 2

Bodies of iron powder of grain size −100 mesh were cold-pressed at 3 kilobars to a density of 70% of the theoretical maximum. By plasma spraying these bodies were provided with a surface layer of aluminium powder, the thickness of the layer for different bodies being 0.25 mm, 0.5 mm, 0.75 mm and 1.0 mm. The bodies were then vacuum-sintered in a furnace at a pressure of 0.05 torr and a temperature of 680° C. for 30 minutes. Thereafter, the pressure was increased to 300 bars and the temperature to 1050° C. During the rise of temperature the pressure further increased to 550 bars, and temperature and pressure were maintained at these values for one hour. For all bodies a density greater than 99% of the theoretical maximum was obtained.

EXAMPLE 3

Bodies of stainless steel powder of quality 316 and grain size −100 mesh were cold-pressed at 3 kilobars to a density of 70% of the theoretical maximum. These bodies were immersed in a solution of fine-grained glass mixed up in methyl alcohol, whereby the bodies acquired a glass powder surface layer having a thickness of about 1 mm. The bodies were then heated under vacuum at a pressure of 0.05 torr and at a temperature of 900° C. for 30 minutes. Thereafter, the temperature was lowered to 700° C., while maintaining the vacuum, after which the pressure was increased to 500 bars and the temperature to 1050° C., which values were maintained for one hour. For these bodies a density greater than 98% of the theoretical maximum was obtained.

EXAMPLE 4

Bodies of iron powder of grain size −100 mesh were treated in the same way as the bodies of stainless steel in Example 3 above. In this case a density greater than 99% of the theoretical maximum was obtained.

EXAMPLE 5

Bodies of tungsten carbide powder of grain size between 0.5 and 10 microns are cold-pressed at 3 kilobars and by plasma spraying provided with a surface layer of cobalt powder, the thickness of the layer being 0.5 to 1.0 mm. The coated bodies are vacuum-sintered in a furnace at a pressure between 1 torr and 0.001 torr and a temperature of 1200° to 1500° C. When the surface layer melts the pressure is increased to at least 700 bars and is maintained at this value for at least 30 minutes, during which time the temperature should be at least 1450° C. After this treatment the bodies have a density greater than 98% of the theoretical maximum.

What is claimed is:

1. A method of manufacturing a sintered body from sinterable powdered material comprising the steps of:

(a) cold-pressing the sinterable powdered material to form a shaped body;

(b) providing the shaped body with an initially porous surface layer having a thickness of up to about 1 mm., said surface layer being comprised of a coating material having a melting point that is lower than the melting point of the sinterable material of the body, said layer being capable of fusing and thereby becoming non-porous and gas-tight upon being heated to a temperature above the melting point of the coating material;

(c) subjecting the shaped body with the porous surface layer thereon simultaneously to vacuum and heating at an elevated first temperature below the melting point of said coating material whereby the evacuation of said shaped body takes place over its whole surface, said evacuation being continued for a time sufficient to degasify the entire shaped body;

(d) thereafter heating the body with the surface layer thereon to a second temperature which is above the melting point of said coating material whereby said layer fuses and is rendered non-porous and gas-tight;

(e) isostatically hot pressing the shaped body with the gas-tight surface layer thereon at a sintering temperature not higher than that at which the coating material is in a fluid high viscous state, said hot pressing being accomplished utilizing an inert gaseous pressure medium which completely surrounds the body and is in direct contact with the entire outer surface of said gas-tight surface layer whereby the sinterable powdered material of the shaped body is compacted and sintered to high density;

(f) said coating material being non-volatile at said second temperature.

2. The method as claimed in claim 1, wherein the coating material during step (d) at least partially penetrates into the pores of the shaped body and seals them in a gas-tight manner.

3. The method as claimed in claim 2, wherein the coating material consists essentially of enamel.

4. The method as claimed in claim 2, wherein the coating material consists essentially of glass.

5. The method as claimed in claim 1, wherein during step (c) the first temperature is maintained at value slightly below the melting point of said coating material for a predetermined period of time.

6. The method as claimed in claim 4, including between steps (d) and (e) the step of reducing the temperature to which the coated shaped body is subjected to a value below the melting point of said coating material so that the coating layer solidifies.

7. The method as claimed in claim 1, wherein the step of providing the shaped body with an initially porous surface layer comprises spraying said coating material onto said shaped body.

8. The method as claimed in claim 4, wherein the pressure medium is selected from the group consisting of argon, helium, nitrogen and hydrogen.

9. The method as claimed in claim 1, wherein the sinterable powdered material consists essentially of at least one member of the group WC, TaC, TiC and VC.

10. The method as claimed in claim 1, wherein the step of providing the shaped body with an initially porous surface layer comprises immersing said shaped body into a liquid containing said coating material.

11. A method of manufacturing a sintered body from sinterable powdered material comprising the steps of:

(a) cold-pressing the sinterable powdered material to form a shaped body;

(b) providing the shaped body with an initially porous surface layer having a thickness of up to about 1 mm., said surface layer being initially comprised of a coating material that is capable of forming, with said sinterable powdered material, a eutectic having a melting point that is lower than the melting point of the sinterable material of the body, said layer being capable of fusing and thereby becoming non-porous and gas-tight upon being heated to a temperature above the melting point of th eutectic;

(c) subjecting the shaped body with the porous surface layer thereon simultaneously to vacuum and heating at an elevated first temperature below the melting point of said eutectic whereby the evacuation of said shaped body takes place over its whole surface, said evacuation being continued for a time sufficient to degasify the entire shaped body;

(d) thereafter heating the body with the surface layer thereon to a second temperature which is above the melting point of said eutectic whereby said layer fuses and is rendered non-porous and gas-tight;

(e) isostatically hot pressing the shaped body with the gas-tight surface layer thereon at a sintering temperature not higher than that at which the eutectic is in a fluid high viscous state, said hot pressing being accomplished utilizing an inert gaseous pressure medium which completely surrounds the body and is in direct contact with the entire outer surface of said gas-tight surface layer whereby the sinterable powdered material of the shaped body is compacted and sintered to high density; and (f) said eutectic being non-volatile at said second temperature.

* * * * *

UNITED STATES PATENT OFFICE
CERTIFICATE OF CORRECTION

PATENT NO. : 4,339,271
DATED : July 13, 1982
INVENTOR(S) : Sven-Erik Isaksson and Hans Larker It is certified that error appears in the above-identified patent and that said Letters Patent are hereby corrected as shown below:

On the title page Insert:

[30] FOREIGN APPLICATION PRIORITY DATA

March 15, 1971 Sweden.....3284/71

Claim 6, line 1, change "4" to --1--.

Signed and Sealed this

Fourth Day of January 1983

[SEAL]

Attest:

GERALD J. MOSSINGHOFF

Attesting Officer

Commissioner of Patents and Trademarks